US005677850A

United States Patent [19]

Ott

[11] Patent Number: 5,677,850

[45] Date of Patent: Oct. 14, 1997

[54] MONITORING SENSOR FOR THE PROTECTION OF COMPUTERS

[76] Inventor: Reinhold Ott, D-70565, Stuttgart, Germany

[21] Appl. No.: 374,147

[22] Filed: Jan. 17, 1995

[30] Foreign Application Priority Data

Jan. 18, 1994 [DE] Germany ..... 44 01 324.8

[51] Int. Cl.[6] ..... G08B 13/04

[52] U.S. Cl. ..... 364/508; 248/551; 340/571; 340/652; 340/687; D13/133; D13/169; D13/176

[58] Field of Search ..... 364/508; 248/551; 340/568, 571, 652, 687; D13/133, 169, 176

[56] References Cited

U.S. PATENT DOCUMENTS

| | | | |
|---|---|---|---|
| D. 232,841 | 9/1974 | Shlesinger et al. | D13/169 |
| D. 317,291 | 6/1991 | Esslinger | D13/133 |
| D. 330,887 | 11/1992 | Wharton | D13/144 |
| D. 354,944 | 1/1995 | Diak et al. | D13/158 |
| 4,935,725 | 6/1990 | Turnau | 340/568 |
| 5,142,269 | 8/1992 | Mueller | 340/568 |
| 5,172,098 | 12/1992 | Leyden et al. | 340/568 |
| 5,268,982 | 12/1993 | Schaffer et al. | 385/86 |
| 5,347,095 | 9/1994 | Zeder | 200/51.09 |

FOREIGN PATENT DOCUMENTS

| | | |
|---|---|---|
| 1499246 | 1/1978 | Germany . |
| 33 02 459 | 11/1983 | Germany . |

*Primary Examiner*—Emanuel T. Voeltz
*Assistant Examiner*—Craig Steven Miller
*Attorney, Agent, or Firm*—Edward J. Timmer

[57] ABSTRACT

In a monitoring sensor for protecting computers and peripheral computer equipment by means of theft protection systems, wherein the sensor has a housing and a sensor element and the housing comprises a coupling member, with which the sensor can be attached to standard connections of the computers and peripheral computer equipment, it is suggested in order to make the monitoring sensor universally usable for standard connections of computers that the sensor element comprise a sensor means and an elastically deformable bending member as position transducer, wherein the sensor means registers the elastic deformation of the bending member and wherein the bending member is arranged adjacent to the coupling member such that it first of all abuts against parts of the standard connection when the sensor is attached to the standard connection and can subsequently be elastically deformed by these parts.

18 Claims, 5 Drawing Sheets

MONITORING SENSOR FOR THE PROTECTION OF COMPUTERS

Figure 1:
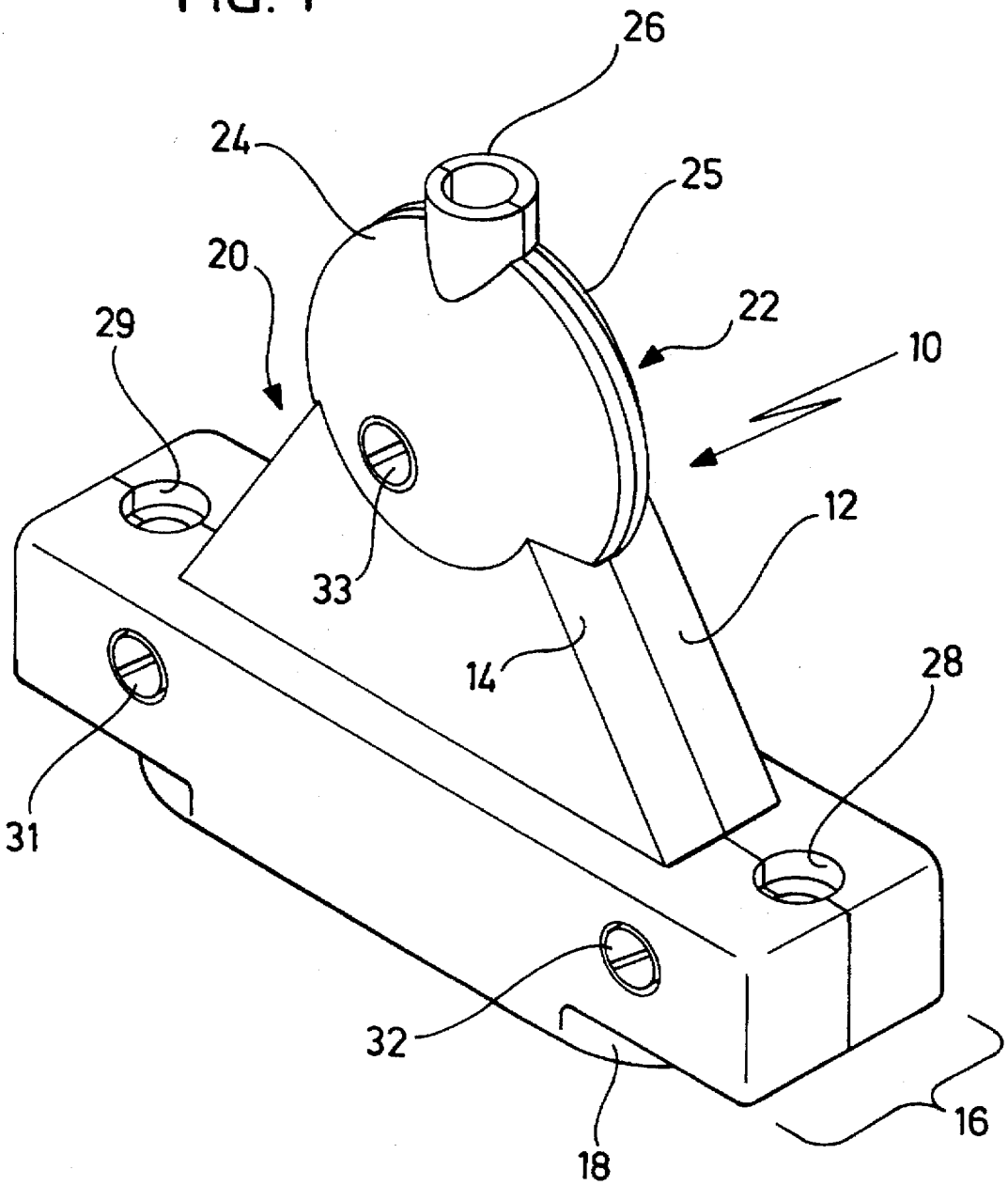

The invention relates to a monitoring sensor for protecting computers and peripheral computer equipment by means of theft protection systems. Such sensors have a housing and a sensor element, whereby the housing comprises a coupling member, with which the sensor can be attached to standard connections of the computers and peripheral computer equipment.

In the case of the previously known sensors of the type described at the outset, referred to in the following in brief as EDP monitoring sensors, it was customary to use as sensor element a microswitch having a switching plunger or stem which was activated directly by the contact pins of the standard connections for the computers or peripheral computer equipment when the monitoring sensor was attached to the corresponding standard connection of the data processing equipment.

The disadvantage of this is that a different monitoring sensor to that for standard pin connections has to be used already for standard jack connections in the data processing equipment. Moreover, it is often the case for standard pin connections that not all the pin positions have pins, partly for safety reasons, partly for coding reasons, and so the same monitoring sensors could not be used for all the standard connections of the computers and peripheral computer equipment. In some cases, there are also problems with the conventional sensors in the activation of the microswitch stems when, in the case of standard pin connections on the computer or peripheral computer device, these stems end up between the pins of the pin connections and thus a reliable activation of the microswitch is not ensured.

The object of the present invention is, therefore, to develop a monitoring sensor of the type described at the outset such that the problems described in the above are avoided and that, in particular, a monitoring sensor which can be used universally for the standard connections of computers or peripheral computer equipment is obtained.

This object is accomplished in accordance with the invention, in the monitoring sensor described at the outset, in that the sensor element comprises a sensor means and an elastically deformable bending member as position transducer, wherein the sensor means registers the elastic deformation of the bending member and wherein the bending member is arranged adjacent to the coupling member and such that it first of all abuts against parts of the standard connection when the sensor is attached to the standard connection and can subsequently be elastically deformed by these parts.

The arrangement of an elastically deformable bending member has the advantage that the bending member can be produced from an electrically insulating material and this creates additional protection against any electrical contact between the circuits of the theft protection system, on the one hand, and the circuits of the devices which are to be protected and monitored, on the other hand. Furthermore, the bending member can be dimensioned such that it essentially has a surface area extension corresponding to that of the standard connections. In this respect, it is unimportant whether the standard connection of the computer or the peripheral computer device is a pin connection or a jack connection since it is ensured that at least one of the elements of the standard connection can elastically deform the bending member.

Monitoring sensors are particularly preferred which have a coupling member designed such that it fits onto the standard connection of a serial or parallel interface. Connections for serial or parallel interfaces are found in practically every computer or peripheral computer device, and in the meantime these standard connections are standardized to a quite considerable extent so that a very broad range of computers and peripheral computer equipment can be protected with two different types of monitoring sensors which differ essentially only in their size, irrespective of the manufacturer of this computer equipment.

For the handling of the monitoring sensors during practical use it is recommendable for the housing to be provided with an opening, into which an LED can be inserted which indicates the state of deformation of the bending member detected by the sensor means, i.e. supplies an optical feedback as to whether the monitoring sensor is correctly attached. Where applicable, it is, in addition, possible for the optical display to be received as a positive feedback only when the connection cable as a whole is also operating without error. This results in an indication for the functional monitoring of the respectively connected device which can be easily checked.

Alternatively or additionally, the optical display can be used to indicate at which of the monitoring sensors a connection to the article to be protected is no longer in order and/or was not in order even for a short time. When using an LED for two status displays, an LED which is switched off can, for example, indicate a connection which is in order and a flashing LED one which is not in order. In this respect, there are, of course, any number of optional alternatives for different flashing signals to indicate functional states of the sensor. For example, a brief lighting up of the LED following connection of the sensor can provide a feedback for the operator concerning the full working order of the sensor and the associated monitoring circuit.

In order to avoid unnecessary false alarms, it is recommendable, in particular when using the monitoring sensors with portable computers and peripheral computer equipment, to provide the sensor housing with at least one holder for a locking screw so that the monitoring sensor attached to the standard connection will not loosen unintentionally and so false alarms are precluded. As stated, this is particularly important in the case of portable equipment because the weight of the device and how easy it is to manage during transport are often decisive features for the buyer when deciding what to buy. Consequently, the articles on display in the showrooms are often picked up and moved.

The bending member can, in principle, have any optional shape as long as it ensures that a mechanical contact with parts of the standard connections is still guaranteed and it undergoes the corresponding deformation, which can be checked via the sensor means, when attached to the standard connections.

A particularly simple and reliably operating solution for this is to provide the bending member as a plastic part in the shape of an essentially rectangular portion cut out of a cylinder wall which is held in two grooves at two opposite regions of the sensor housing. The curvature of the bending member is thereby directed outwards and the radius of curvature of the bending member becomes greater when the monitoring sensor is attached to the corresponding standard connection and the bending member is thereby deformed. The displaceable mounting in the grooves of the sensor housing allows the length of the secant of the portion from the cylinder wall to be varied and, therefore, the bending member to be easily deformable as well. At the same time, this results in a very simple installation possibility since the bending member has to be inserted only into the two grooves and requires no further attachment whatsoever.

An output signal which is particularly simple to process with respect to circuit technology is supplied by monitoring sensors, in which the sensor means takes up a first switching state in the undeformed state of the bending member and a different, second switching state in the deformed state of the bending member. A microswitch, the actuating member of which abuts on the inner surface of the bending member, is then, for example, suitable as sensor means for this purpose. So-called toggle switches can be advantageously used as microswitches, whereby the type as changeover switch is preferred in this case.

A preferred type of microswitch has an elastically deformable actuating member so that the entire arrangement of the sensor element, i.e. sensor means and bending member, is automatically adaptable to different geometries on the part of the standard connection and thus the extensive standardization of the monitoring sensors is made easier.

Sensor means are preferred for the monitoring sensor which take up the second state following a deformation of the bending member of approximately 50% or more. The percentage given relates to the resulting deformation path of the bending member in the unloaded state relative to the duly attached state.

The bending member is preferably dimensioned such that it can be deformed by the edge regions of the standard connections. This results in a bodily contact of the bending member with the standard connection part which is possible over the entire length of the standard connection, irrespective of the presence of connector pins and/or the height of the jack body of a connector jack as standard connection. Moreover, this embodiment of the bending member avoids any contact with the connector pin contacts of a standard connection so that even in unfavorable cases, such as, e.g., with a soiled bending member, no conductive contact can be established between pin contacts.

The monitoring sensor will preferably comprise a housing which is constructed of two half shells essentially in mirror symmetry. These two half shells each include, where applicable, half of the two respective grooves receiving the bending member which represents a portion cut out of a cylinder wall. When the housing is assembled, the bending member need be inserted only into one half shell before the second half shell is attached, whereby the bending member which consists of a material having adequate strength and rigidity, which are necessary for a prolonged alternating loading, can be fixed in position in the housing.

The connection cable required for connecting the monitoring sensor to the theft protection system can, in principle, be provided at any point of the housing. However, the two half shells preferably form a passage for a connection cable opposite to the coupling member of the housing. This permits a simple cable guidance within the housing.

The passage for the connection cable preferably comprises an annular groove, in which a projection of a strain relief sleeve securable on the connection cable can engage. In this way, the strain relief sleeve need only be pushed onto the connection cable and securely connected to the connection cable by, for example, deformation and the projection arranged to engage in the annular groove during assembly of the two half shells in order to achieve a stable strain relief for the connection cable.

A design of the housing of the monitoring sensor which is particularly simple and easy to handle is provided when the sensor housing comprises a trapezoidal section adjacent to the coupling member and this section merges into a disk-shaped part in which a passage for the connection cable is arranged. Due to the combination of the trapezoidal section and the disk-shaped part, the monitoring sensor is particularly easy to hold and detach again from the standard connections. This is made even easier when the disk-shaped part of the housing is essentially formed from two spherical bodies arranged in mirror image, whereby the thickness of the disk-shaped part, measured at the peak of the spherical bodies, is greater than the thickness of the housing in the trapezoidal section. The housing of such a monitoring sensor is particularly easy to handle and also makes an optically attractive impression.

Only a microswitch has so far been discussed in detail as sensor element. This does represent the simplest embodiment of the sensor means with respect to circuit technology but not the only possible one.

Figure 2:
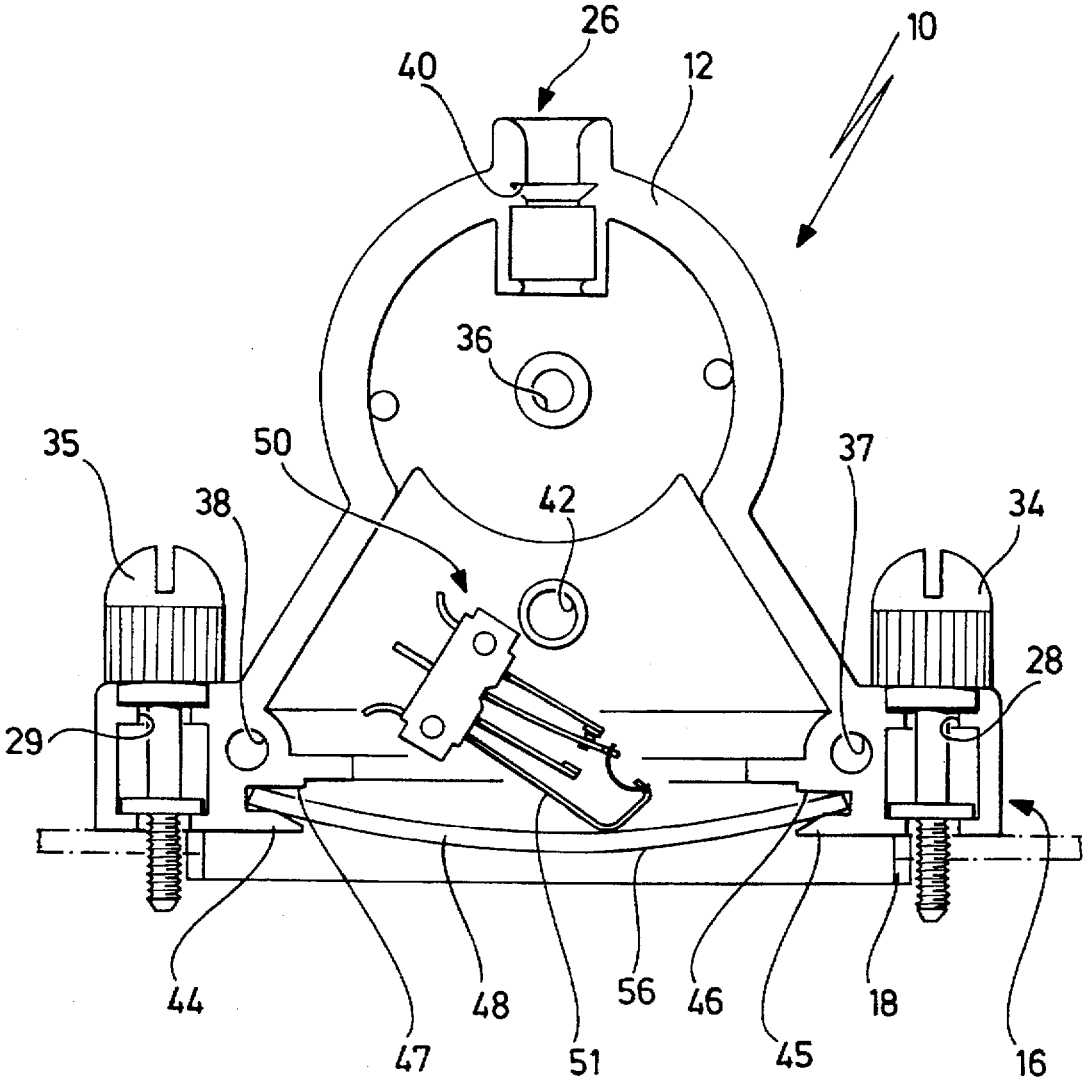
Figure 3:
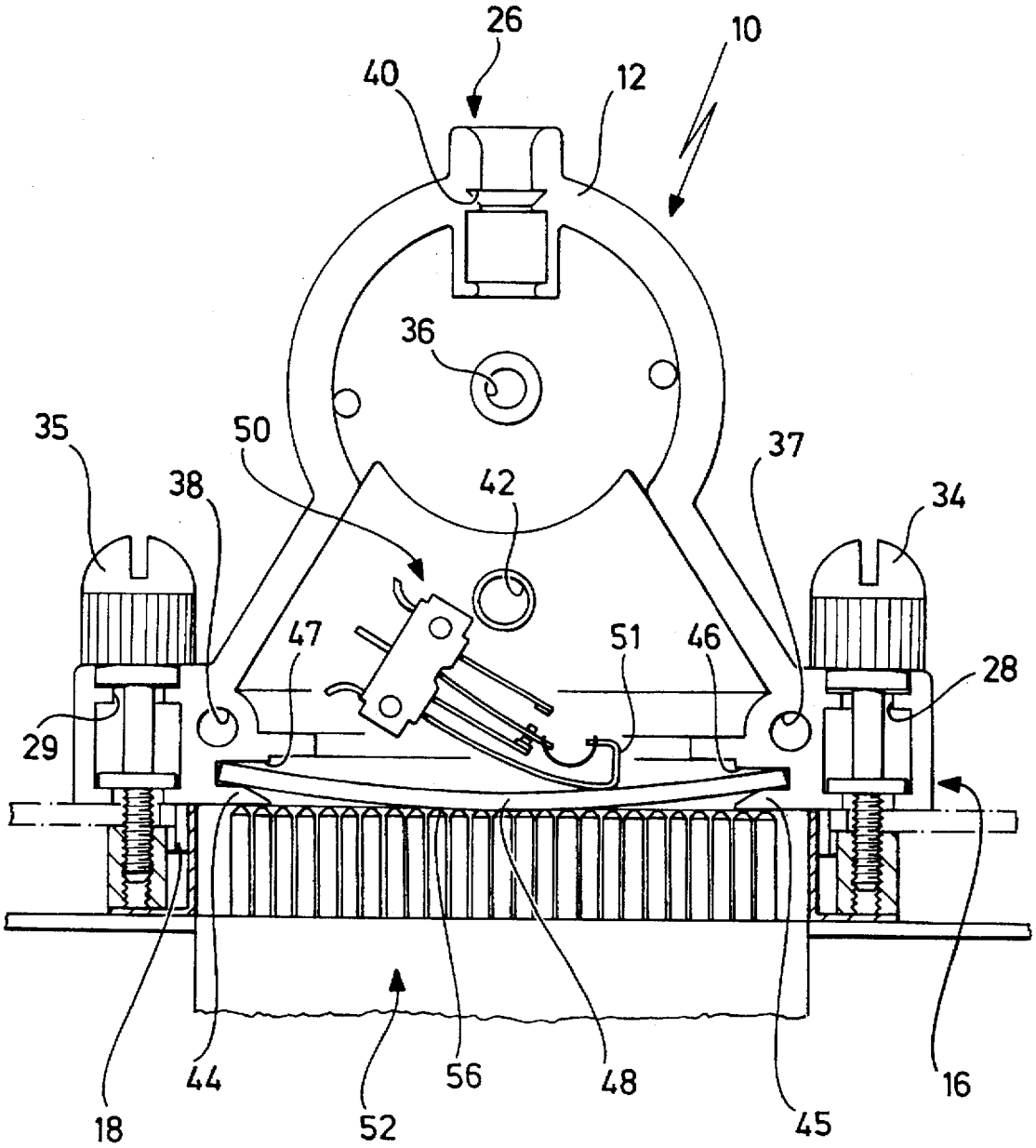
Figure 4:
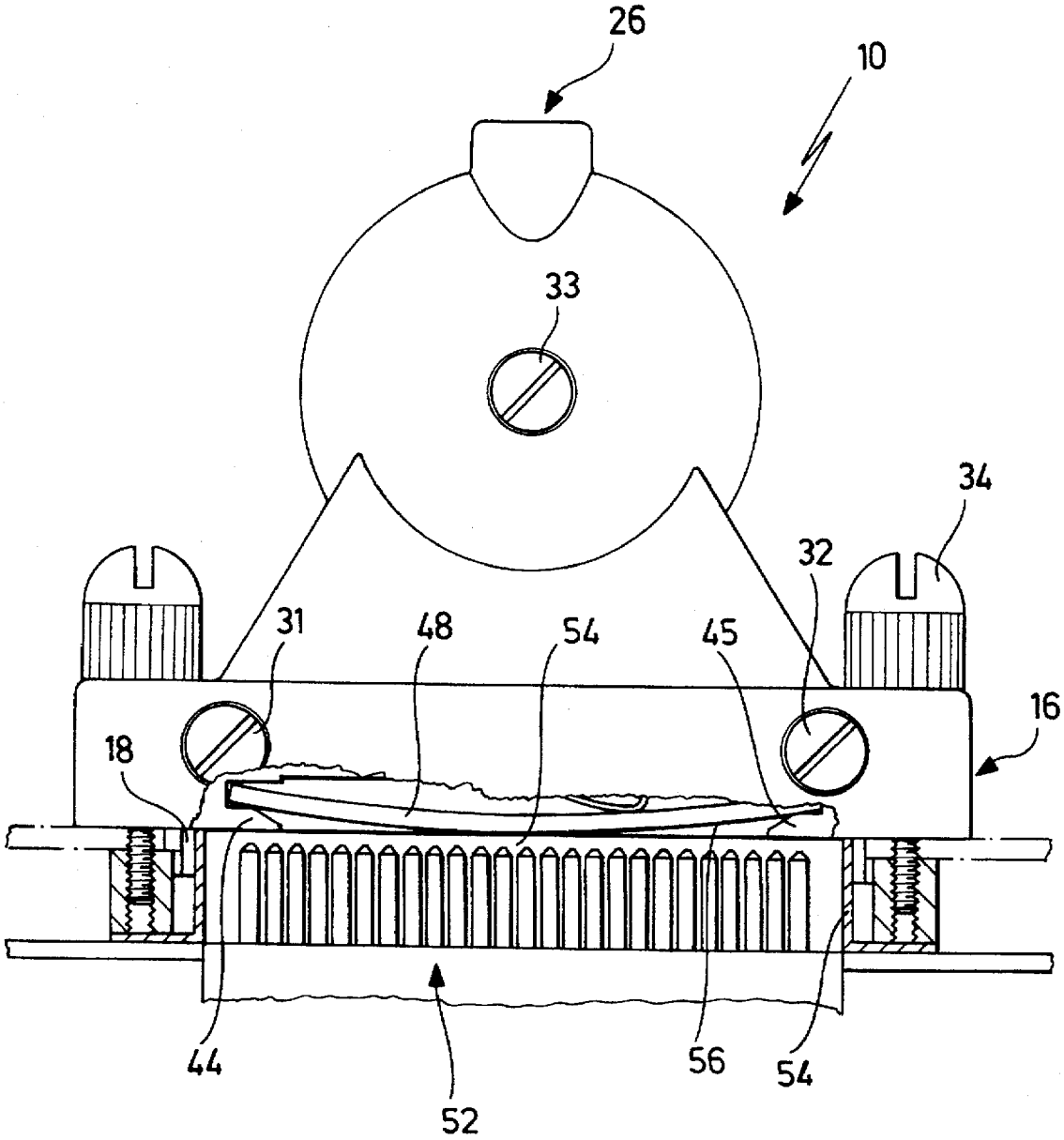
Figure 5:
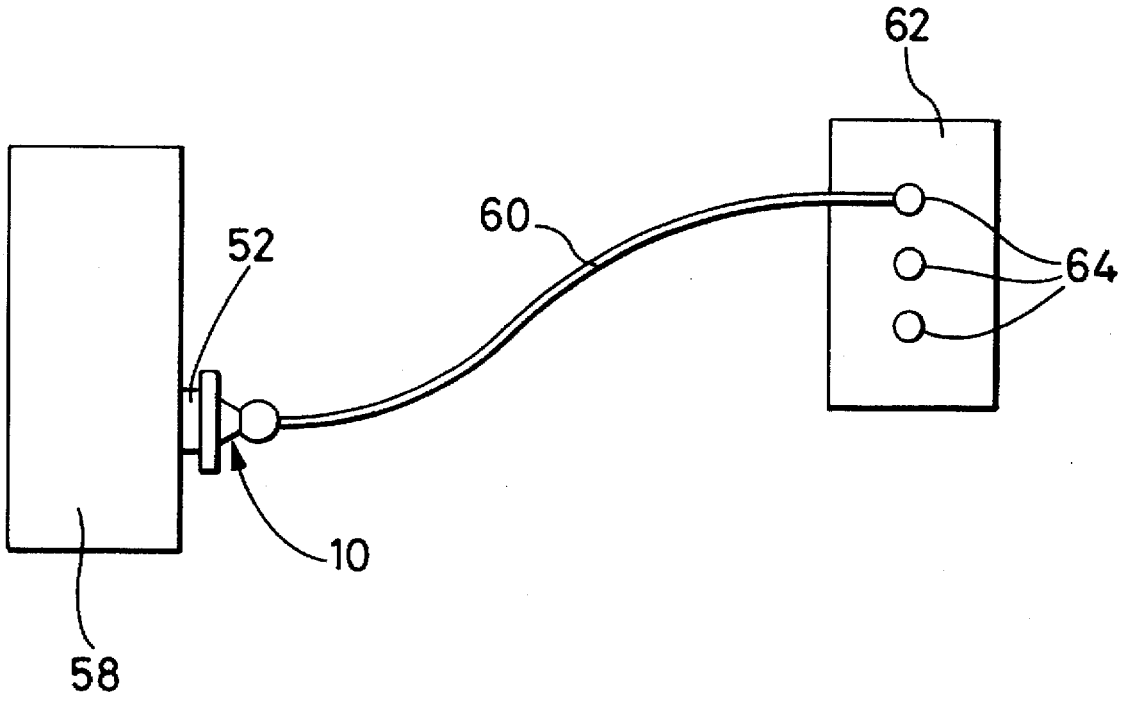

Especially in the case of housings for the monitoring sensor which are to be kept particularly small, it is possible for the sensor means to be a strain gauge which is connected to the inner side of the bending member so that deformations of the bending member cause a variation in the resistance of the strain gauge. In this manner, monitoring sensors having a particularly small construction can be realized and these are, for example, not very much larger than customary protective covers for the standard connections. These and further advantages of the invention will be explained in greater detail in the following on the basis of the drawings. The drawings show in detail:

FIG. 1 a perspective view of an inventive monitoring sensor;

FIG. 2 a plan view onto one half of an opened monitoring sensor in the first switching state of the sensor means;

FIG. 3 the monitoring sensor from FIG. 2 in an attached state on a standard connection with the sensor means in a second switching position;

FIG. 4 a further embodiment of a monitoring sensor in a partially cutaway illustration in an attached state corresponding to FIG. 3; and FIG. 5 a schematic illustration of an inventive monitoring sensor connected to an article to be protected and to a theft protection system.

FIG. 1 shows a monitoring sensor which is provided as a whole with the reference numeral 10 and which comprises a housing consisting of two half shells 12, 14. The half shells 12 and 14 form an essentially parallelepiped coupling member 16 which comprises on its underside a protruding edge 18 which can be attached to a standard connection of a computer or a peripheral computer device.

On its upper side, the coupling member 16 bears a trapezoidal part 20 which merges into a disk-shaped part 22. The disk-shaped part 22 essentially consists of two spherical body parts 24, 25 which are arranged in mirror image and bear a collar 26 at their region facing away from the trapezoidal part; a connection cable (not illustrated) can be introduced into the monitoring sensor 10 through this collar. The parallelepiped coupling member 16 has at opposite ends passages 28, 29, through which assembly screws or other fastening elements can be inserted and connected to the standard connection on the article.

The two half shells 12 and 14 of the housing of the monitoring sensor 10 are, finally, securely connected to one another via three assembly screws 31, 32, 33.

FIG. 2 shows the inventive monitoring sensor 10 from FIG. 1 in an opened state, i.e. here, in particular, the half shell 12 of the housing of the monitoring sensor 10. In the illustration of FIG. 2, locking screws 34, 35 are inserted into the passages 28, 29 and bear on their thread-less part a shoulder which prevents the screw from falling out of the passages 28, 29 in the assembled state of the two half shells 12 and 14. The half shell 12 contains three bores 36, 37, 38, into which the screws 31, 32, 33 necessary for assembly can be screwed.

The collar 26 continues into the interior of the housing and has an annular groove 40 approximately halfway along its length, in which a projection of a cylindrical sleeve secured in position on the connection cable, which is not illustrated, can engage and thus secures the connection cable in the sleeve and simultaneously provides a strain relief.

Furthermore, the half shell 12 has a through opening 42, through which an LED can be inserted for optically indicating the operational state of the sensor 10 (not illustrated).

The surface adjacent the edge 18 of the parallelepiped part 16 is recessed to a considerable extent so that only edges 44, 45 remain of the bottom surface of the parallelepiped part 16. A groove 46, 47 is provided behind each of these remaining areas of the underside and these grooves widen on one side towards their open end.

A bending member 48 is inserted into the grooves 46, 47 and this represents an essentially rectangular portion cut out of a cylinder wall. The bending member itself is preferably produced from a plastics material and is dimensioned in its length such that it can be inserted into the grooves 46, 47 without any initial tensioning. At the same time, the bending member 48 closes the opening of the housing consisting of the half shells 12 and 14 which is formed between the edges 44 and 45.

On its rear side, the bending member is in mechanical contact with the actuating member 51 of a microswitch 50. Preferably, the actuating member 51 of the microswitch 50 is, as in the present case, of an elastic design, here in the form of an elastic metal strip, which abuts resiliently on the inside of the bending member 48 in the housing.

FIG. 2 shows the actuating member 51 in the untensioned state and therefore the microswitch 50 in a first switching position which corresponds to the non-connected state of the monitoring sensor.

When the sensor 10, as shown in FIG. 3 or 4, is attached to a standard connection 52 of a computer (not illustrated) with its housing consisting of the half shells 12 and 14, the bending member 48 is deformed due to the contact with connector pins of the standard connection 52 (FIG. 3) or due to the contact with a metal edge 54 of the standard connection 52 (FIG. 4). The deformation of the bending member 48 is transferred to the actuating member 51 of the microswitch 50, the elastic deformation of which, on the other hand, causes the microswitch 50 to switch over into a second switching position after a predetermined switching distance.

As soon as the monitoring sensor 10 has been removed from the standard connection 52, the bending member 48 springs back into its initial position (cf. FIG. 2) and allows the actuating member 51 to also return to its first switching position. A signal is then sent to the monitoring circuit of a theft protection system (both not shown) which causes an alarm to be triggered.

The novel shape for the housing of the monitoring sensor can be used just as well for computer plug connections. For this reason, the special design of the housing consisting of the trapezoidal part followed by the disk-shaped part is also claimed independently of the use of the housing for a monitoring sensor.

The small constructional shape, on the one hand, and, nevertheless, good gripping and handling characteristics are the essential advantages of the selected housing shape. In addition, the new housing shape also has an aesthetically pleasing appearance.

An essential idea of the invention is also to be seen in the fact that the bending member 48 is designed with respect to its surface area such that when the sensor 10 is placed on the standard connection 52 parts of the standard connection 52 come to rest on the bending member. These parts can be contact pins, a jack body or also the edge 54 of the standard connection 52 already mentioned. When the sensor 10 is inserted further, the parts of the standard connection 52 resting on the bending member 48 cause the bending member 48 to deform and this is detected by the microswitch 50 or another sensor means.

The bending member 48 preferably has a contact surface 56 which extends essentially transversely to the insert direction of the sensor 10. This surface is formed in the embodiments described by the curved outer surface of the bending member 48 facing the standard connection 52. The contact surface 56 which extends essentially transversely to the insert direction ensures that parts of the standard connection 52 come to rest on the contact surface 56 when the sensor 10 is inserted, irrespective of their exact position when they are, for example, bent or also when individual parts are missing. This means that a reliable detection of an inserted state of the sensor 10 is always possible.

In the illustrated embodiment, the bending member 48 is formed by an essentially rectangular, flat strip, the center of which, at least in the non-inserted state, is curved outwardly in the direction of a standard connection 52 to be inserted. The strip has a uniform width along its length and this is preferably selected such that the longitudinal edge of the bending member 48 overlaps the longitudinal sides of the standard connection 52 which is normally oblong, including the metal edge 54, in order to always ensure a reliable contact to parts of the standard connection 52 when the sensor 10 is inserted. Alternatively, the bending member 48 can, for example, be of a narrower design and have a broadened section to form the contact surface 56.

FIG. 5 shows a schematic illustration of an inventive monitoring sensor 10 which is inserted into a standard connection 52 of an article 58 to be protected, such as a personal computer or the like. A connection cable 60 connects the sensor 10 with a theft protection system 62. This has at least one, preferably several connections 64 for the connection of monitoring sensors 10. In this respect, each sensor 10 can be connected with its connection cable 60 to one connection 64, for example via a plug connector, and monitored by the theft protection system 62.

The bending member 48 designed as position transducer is deformed due to the insertion of the sensor 10 into the standard connection 52 of the article 58. This deformation is mirrored in the switching state of the microswitch 50. The electrical switching state of the microswitch 50 and, with it, the status of the sensor 10, namely whether this is inserted or not, is transmitted to the theft protection system 62 via the connection cable 60. Consequently, this can trigger an alarm when required.

Due to the large number of connections 64, the theft protection system can monitor a plurality of sensors 10 independently of one another. Furthermore, the connection cable 60 and the theft protection system 62 are designed such that any short circuit which may occur or any separation of the connection due to manipulations are also detected and an alarm triggered.

What is claimed is:

1. Monitoring sensor for protecting computers and peripheral computer equipment and having a sensor housing and a sensor element, wherein the housing comprises a coupling member, said sensor being attachable to a standard connection of a computer or peripheral computer equipment with said coupling member, characterized in that the sensor element (50,48) comprises a sensor means (50) and an elastically deformable bending member (48) as position transducer, wherein said sensor means (50) registers the elastic deformation of the bending member (48), wherein the bending member (48) is dimensioned such that it essentially has a surface area extension corresponding to that of the standard connection and wherein the bending member (48) is arranged adjacent to the coupling member (16,18) and such that it first abuts against a part of the standard connection (52) when the sensor (10) is attached to the standard connection (52) and is subsequently elastically deformed by said part.

2. Monitoring sensor as defined in claim 1, characterized in that the coupling member (16, 18) fits onto the standard connection of a serial or parallel interface.

3. Monitoring sensor as defined in claim 1, characterized in that the bending member (48) is produced from an electrically insulating material.

4. Monitoring sensor as defined in claim 1, characterized in that the housing has an opening for insertion of an LED indicating the functional status of the monitoring sensor, including the state of deformation of the bending member detected by the sensor means.

5. Monitoring sensor as defined in claim 1, characterized in that the sensor housing (12, 14) comprises at least one holder (28, 29) for a locking screw (34, 35).

6. Monitoring sensor as defined in claim 1, characterized in that the bending member (48) is a plastic part in the shape of an essentially rectangular portion cut out of a cylinder wall, said portion being displaceably held in two grooves (46, 47) at two opposite regions of the sensor housing.

7. Monitoring sensor as defined in claim 1, characterized in that the sensor means takes up a first switching state in the undeformed state of the bending member (48) and a different, second switching state in the deformed state of the bending member (48).

8. Monitoring sensor as defined in claim 7, characterized in that the sensor means (50) takes up the second state following a deformation of the bending member (48) of approximately 50% or more.

9. Monitoring sensor as defined in claim 1, characterized in that the bending member (48) is dimensioned such that it is deformable by edge regions (54) of the standard connection.

10. Monitoring sensor as defined in claim 1, characterized in that the housing is constructed of two half shells (12, 14) essentially in mirror symmetry.

11. Monitoring sensor as defined in claim 10, characterized in that opposite to the coupling member (16) of the housing the two half shells (12, 14) form a passage (26) for a connection cable.

12. Monitoring sensor as defined in claim 11, characterized in that the passage (26) comprises an annular groove (40), a projection of a strain relief sleeve securable on the connection cable (60) being adapted to engage in said groove.

13. Monitoring sensor as defined in claim 1, characterized in that the sensor housing comprises a trapezoidal section (20) adjacent to the coupling member (16), said section merging into a disk-shaped part (22) having a passage for the connection cable arranged therein.

14. Monitoring sensor as defined in claim 13, characterized in that the disk-shaped part (22) of the housing is essentially formed of two spherical bodies arranged in mirror image and that the thickness of the disk-shaped part (22) measured at the peak of the spherical bodies is greater than the thickness of the housing in the trapezoidal section (20).

15. Monitoring sensor as defined in claim 1, characterized in that the sensor means is a strain gauge connected to the inner side of the bending member (48).

16. Monitoring sensor as defined in claim 1, characterized in that the sensor means is a microswitch (50).

17. Monitoring sensor as defined in claim 16, characterized in that the microswitch (50) is a toggle switch.

18. Monitoring sensor as defined in claim 16, characterized in that the microswitch (50) is a changeover switch.

* * * * *